United States Patent [19]

Iwaya

[11] Patent Number: 5,063,893

[45] Date of Patent: Nov. 12, 1991

[54] PISTON STRUCTURE FOR INTERNAL COMBUSTION ENGINE

[75] Inventor: Naohiro Iwaya, Kanagawa, Japan

[73] Assignee: Atsugi Unisia Corporation, Kanagawa, Japan

[21] Appl. No.: 526,670

[22] Filed: May 22, 1990

[30] Foreign Application Priority Data

May 22, 1989 [JP] Japan ..... 1-58088[U]

[51] Int. Cl.[5] ..... F02F 3/00

[52] U.S. Cl. ..... 123/193 P; 92/238; 92/239

[58] Field of Search ..... 123/193 P; 92/207, 238, 92/239

[56] References Cited

U.S. PATENT DOCUMENTS 4,358,881 11/1982 Mahrus et al. ..... 92/238
4,702,151 10/1987 Munro et al. ..... 92/239
4,709,621 12/1987 Matsui et al. ..... 123/193 P
4,785,774 11/1988 Tokoro ..... 92/239
4,887,519 12/1989 Steidle ..... 123/193 P

*Primary Examiner*—Andrew M. Dolinar
*Assistant Examiner*—M Macy
*Attorney, Agent, or Firm*—Ronald P. Kananen

[57] ABSTRACT

A piston for an internal combustion engine is provided. This piston includes a piston body which has an upper ring land portion and a skirt portion, pin boss portions formed in the skirt portion into which a piston pin is inserted for attaching the piston body to a connecting rod, and a rib portion projecting from an inner wall of the skirt portion. The rib portion extends from the first areas which include cross points where the centerline, perpendicularly passing the longitudinal axis of the pin boss, intersects the inner wall of the piston skirt to the second areas which include the bottoms of the pin boss portions.

7 Claims, 4 Drawing Sheets

PISTON STRUCTURE FOR INTERNAL COMBUSTION ENGINE

BACKGROUND OF THE INVENTION

1. Technical Field

The present invention relates generally to a piston structure for an internal combustion engine, and more particularly to an improved rib reinforcement to provide a necessary rigidity to a piston skirt.

2. Background Art

A piston structure is well known in the art which includes a uniformly wide rib reinforcement extending around the inner peripheral surface of a piston skirt on a plane perpendicular to the centerline of a piston. This rib reinforcement is positioned at a lower portion of the piston skirt and adjacent the bottom of a pin boss into which a piston pin is inserted to attach a connecting rod. The piston further includes a slipper portion extending below the rib reinforcement for reducing noise or wear thereof due to reciprocating motion of the piston during combustion.

However, in the above conventional piston structure, because the uniformly wide rib reinforcement extends horizontally with respect to the piston stroke, provision of the slipper portion is necessary below the piston skirt to absorb side thrust acting on the piston during combustion for reducing the noise and vibration. It will be appreciated that the piston is lengthened and the weight thereof is increased due to this construction. Thus, this structure is unsuitable for high speed engines. Further, if the width of the rib reinforcement is increased to provide proper rigidity for the piston skirt, the piston is subject to overheating.

SUMMARY OF THE INVENTION

It is accordingly one object of the present invention to avoid the disadvantages of the prior art.

It is another object of the invention to provide an improved piston structure which includes a relatively small rigid portion without reducing the necessary mechanical strength of a piston skirt to provide a small, light weight piston.

According to one object of the present invention, there is provided a piston structure for an internal combustion engine which comprises a piston body including a hollow skirt portion, pin boss portions provided in the skirt portion into which a piston pin is inserted for attaching the piston body to a connecting rod, the pin boss portions having a common longitudinal axis, and a rib portion projecting from an inner wall of the skirt portion to reinforce the rigidity of the skirt portion, the rib portion extending from a first area which includes at least the cross point where the centerline, perpendicularly passing the longitudinal axis of the pin boss, intersects the inner wall of the piston skirt to a second area which includes at least a bottom portion of the pin boss portion.

According to another aspect of the invention, there is provided a piston structure for an internal combustion engine which comprises a piston body including a hollow skirt portion, pin boss portions provided in the skirt portion into which a piston pin is inserted for attaching the piston body to a connecting rod, the pin boss portions being diametrically opposed to each other, and a curved rib portion projecting from an inner wall of the skirt portion to provide reinforcement to the skirt portion, the curved rib portion extending along the inner wall of the skirt portion to form portions which provide rigidity to absorb side thrust acting on the piston body during combustion at both sides of the pin boss portion.

BRIEF DESCRIPTION OF THE DRAWINGS

The present invention will be understood from the detailed description given hereinbelow and from the accompanying drawings of the preferred embodiments which are given for explanation and understanding only and are not intended to imply limitation to the invention.

DESCRIPTION OF THE PREFERRED EMBODIMENT

Figure 1:
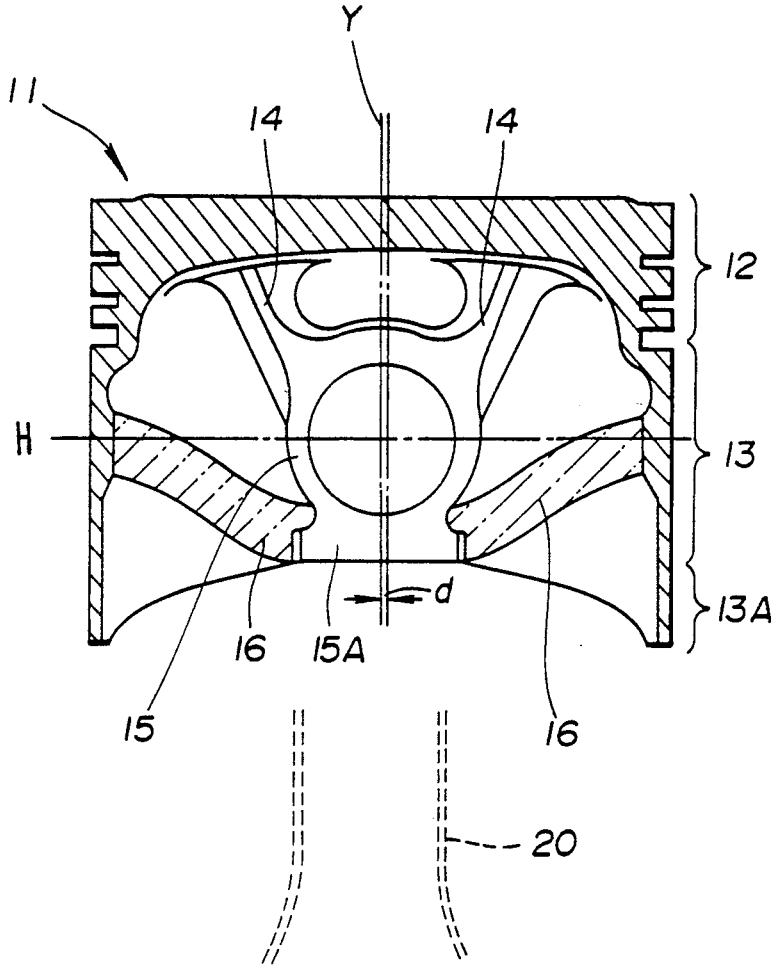
FIG. 1 is a front sectional view which shows a piston structure according to the invention.
Figure 2:
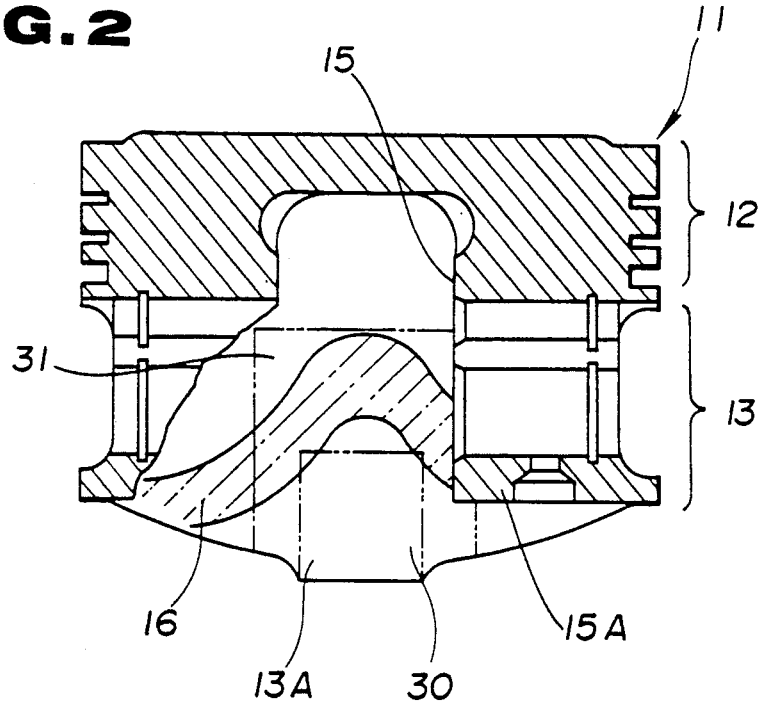
FIG. 2 is a side sectional view of FIG. 1.

Referring now to the drawings, wherein like numbers refer to like parts in several views, particularly to FIGS. 1 and 2, a piston for an internal combustion engine according to the present invention is shown. This piston 11 is a so-called slipper-skirt piston and generally includes an upper ring land portion 12 and a hollow cylindrical piston skirt 13 having a thick wall, which are intergrally formed to one another. Ribs 14 extend downward from an inner wall behind a piston head and two pin bosses 15 are formed in the junctions of the ribs. The pin bosses are diametrically opposed to each other for receiving a piston pin (not shown) to attach the piston to a connecting rod 20. Each pin boss 15 is offset from the centerline Y of the piston 11 so that the center points thereof are spaced from the centerline by a distance d for slightly shifting location of the piston at the top dead center.

The piston 11 further includes curved rib reinforcements 16, as shown by broken lines in the drawings, each of which projects from an inner wall of the piston skirt 13 by a preselected height. Each rib reinforcement 16 extends upward from a portion adjacent the respective bottom 15A of the respective rib junction or pin boss portion 15 along the inner wall of the piston skirt so that the top portion of the rib reinforcement is located at the cross point where the centerline H, perpendicularly passing the longitudinal axis of the pin boss, intersects the inner wall of the piston skirt 13. Skirt extending portions 13A are provided at both sides of the pin bosses below the piston skirt 13.

Generation of side thrust acting on the piston 11 during reciprocating motion of the piston causes the contact area of the piston skirt with a cylinder wall to be changed constantly as is well known in the art. The side thrust is the product of combustion pressure applied to the piston head and inertia force of reciprocating parts. With the above mentioned piston construction, during small side thrust being exerted on the piston 11, a relatively low rigidity portion of the piston skirt 13, below the rib reinforcement in a direction perpendicular to the centerline of the pin boss 15, contacts the cylinder wall to absorb shock acting on the piston due to side thrust, slightly deforming the contact area. As the side thrust becomes greater, the contact area of the piston skirt with the cylinder wall extends over a relatively high rigidity portion. On the other hand, as the side thrust becomes lower, the constant area is reduced. Therefore, as shown in FIG. 2, when the side thrust is relatively small, the lower rigidity portion 30 (defined by a broken line) of the piston skirt 13 below the rib reinforcement contacts the cylinder wall. As the side thrust becomes greater, the contact area expands over the higher rigidity portion 31.

Thus, a portion of the piston skirt, including the extending portion 13A below the rib reinforcement 16, functions as an absorber as is provided by a slipper portion of a conventional piston structure. It will be appreciated that lengthening of the extending portion 13A is unnecessary and thus a shortened piston skirt is obtained.

Figure 3:
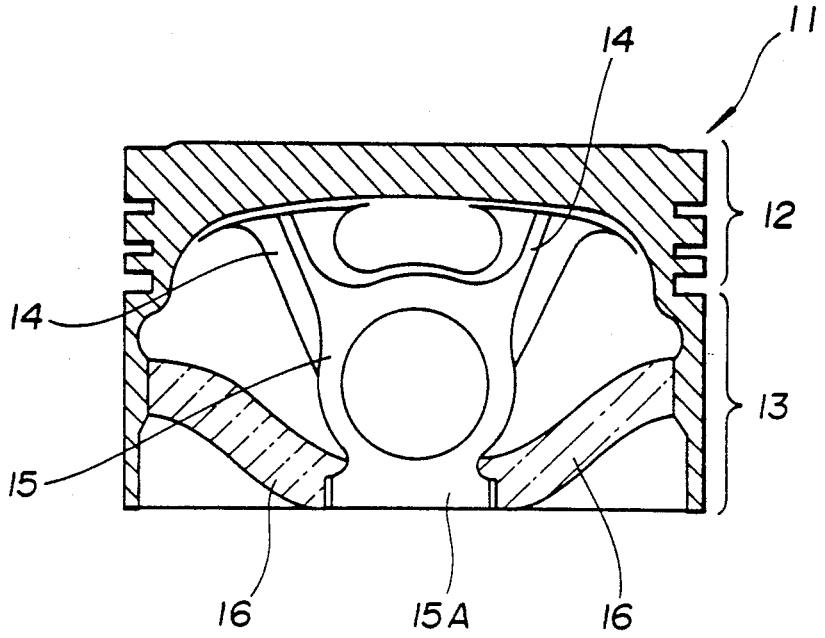
FIG. 3 is a front sectional view which shows a second embodiment of a piston structure of the invention.
Figure 4:
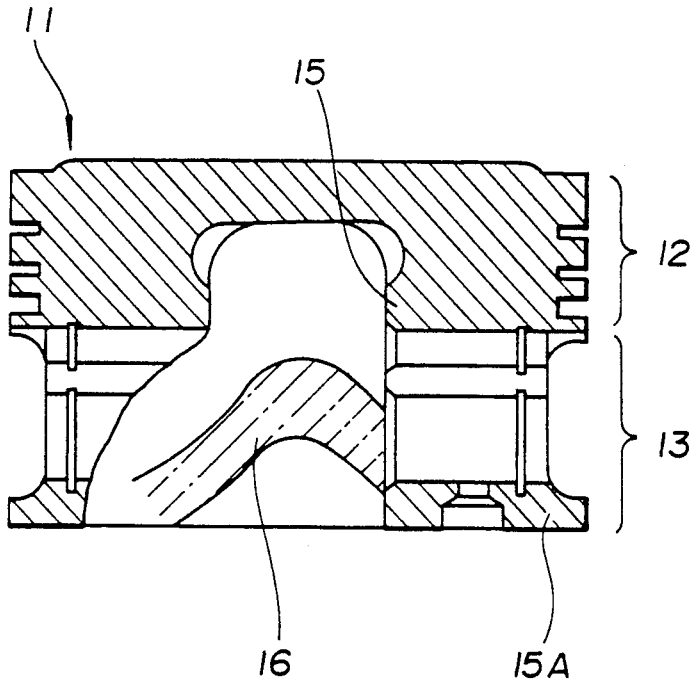
FIG. 4 is a side sectional view of FIG. 3.

Referring to FIGS. 3 and 4, a second embodiment of a piston structure according to the invention is shown. A piston 11 is designed to cut out the extending portion 13A of the piston skirt 13 of the first embodiment for reducing piston weight and shortening piston length because an upwardly curved rib reinforcement provides a shock absorbing area of the piston skirt below the rib reinforcement similar to the slipper portion of the conventional piston structure. With this structure, a flat surface of the bottom of the piston 11 is provided. A relatively wider area having a lower rigidity can however be formed.

Figure 5:
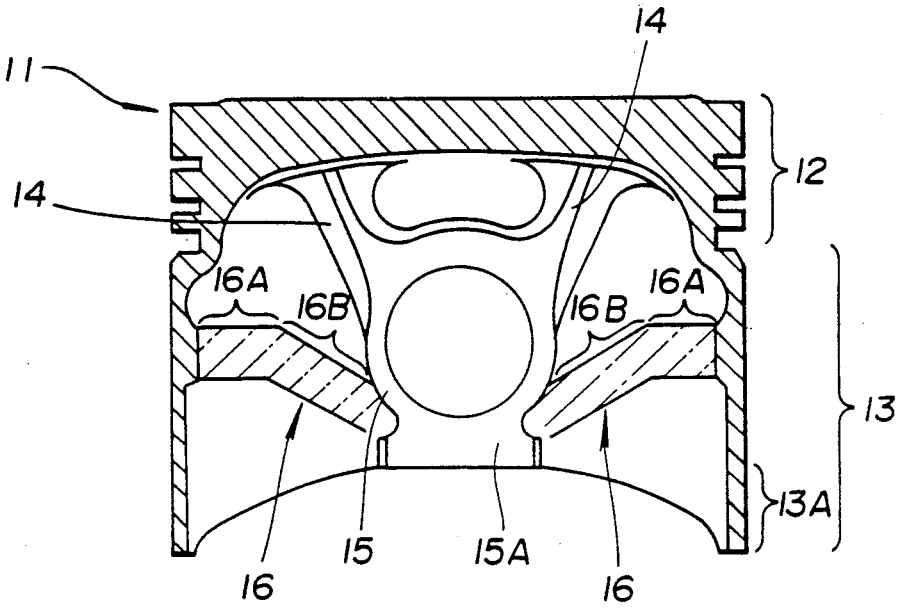
FIG. 5 is a front sectional view which shows a third embodiment of a piston structure.
Figure 6:
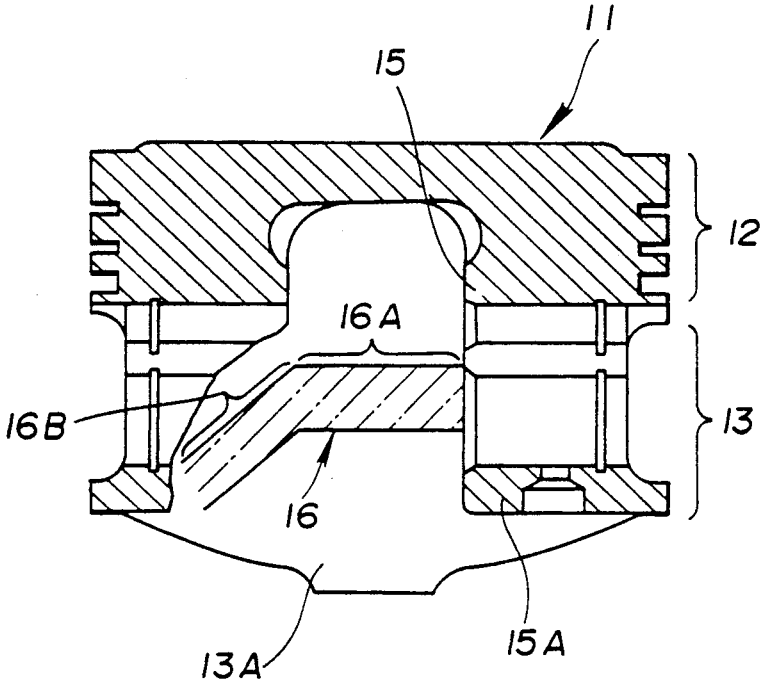
FIG. 6 is a side sectional view of FIG. 5.

Referring to FIGS. 5 and 6, a third embodiment of a piston structure is shown. In this structure, each rib reinforcement 16 is designed such that it extends straight from a portion adjacent the respective bottom 15A of the respective pin boss portion 15 along an inner wall of the piston skirt 13 and then folds horizontally. It will be noted that the rib reinforcement is provided with a plurality of straight segments 16A and 16B. In addition, similar to the second embodiment, the extending portion 13A of the piston skirt 13 may be omitted to form a flat bottom thereof. It will be appreciated that the same effect as that of the above mentioned piston structure which includes a curved rib reinforcement may be obtained.

Figure 7:
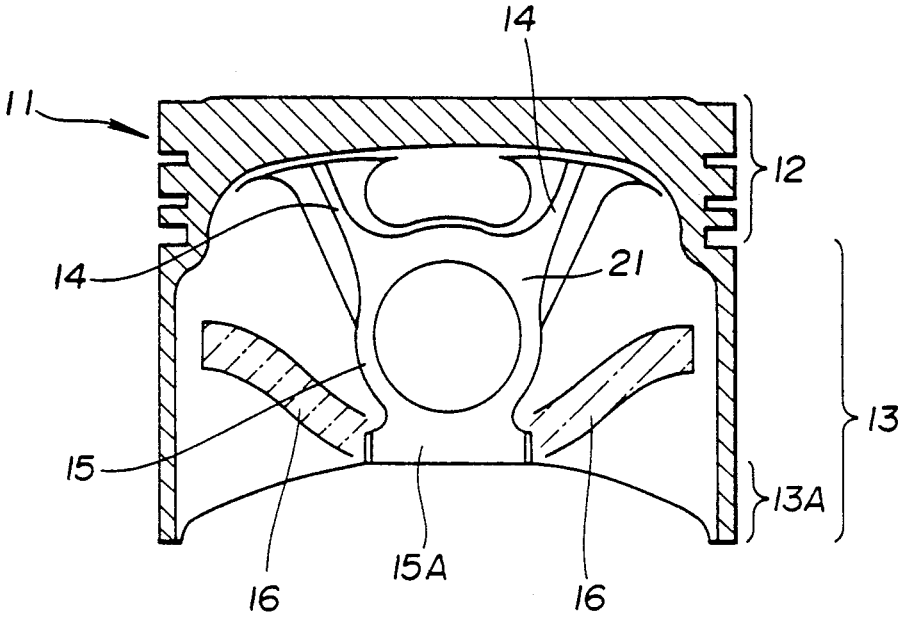
FIG. 7 is a front sectional view of a fourth embodiment of a piston structure.
Figure 8:
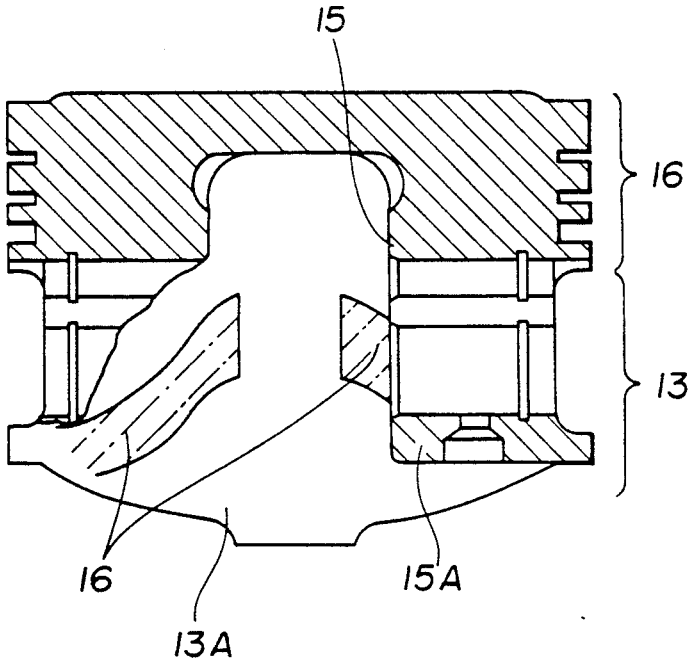
FIG. 8 is a side sectional view of FIG. 7.

Referring to FIGS. 7 and 8, a fourth embodiment of a piston structure of the invention is shown. This embodiment is an example in a case where a piston is formed by a three separate dies. Four separate rib reinforcements are provided which include no curved or flat top portion similar to the above embodiment due to molding utilizing separate dies. However, there is no problem in practice and the same advantages are obtained.

As is clear from the above description, with the piston structure according to the present invention, a relatively low rigidity portion is provided with an improved strength of the piston skirt to shorten the piston skirt and thus reduce the weight and over all length of a piston while preventing overheating. As a result of the reduced weight of the rotation ports, generation of vibration is prevented. Further, when side thrust acting on a piston is small, the portion where a cylinder reacts against a piston wall via lubricating oil is limited to the narrow and relatively low rigidity portion to prevent it from being worn.

Although specific embodiments of the invention have been described in detail herein with reference to the accompanying drawings, it will be understood that the invention is not limited to those specifically disclosed embodiments, and that various changes and modifications may be effected therein by one skilled in the art without departing from the scope or sprit of the invention as defined in the appended claims. For example, in each above embodiment, wall thickness in a radial direction of the piston and width of the rib reinforcement is not always uniform and it may be varied. The lower ends of the rib reinforcements, as mentioned above, may be positioned in the vicinity of the bottoms 15A of the pin boss portions 15 respectively, while each may alternatively be integrally connected to the bottom of the pin boss portion.

What is claimed is:

1. A piston structure for an internal combustion engine comprising:

a piston body including a hollow skirt, said piston body having a longitudinal center line extending in a direction of reciprocating motion during combustion;

pin boss portions provided in the skirt portion into which a piston pin is inserted for attaching said piston body to a connecting rod, said pin boss portions having a common longitudinal axis; and a rib portion projecting from an inner wall of said skirt portion to reinforce the rigidity of a first portion said skirt, said rib portion extending from a first area of said inner wall of said skirt to a second area, wherein said first area includes at least the cross point where a line, perpendicularly passing the longitudinal axis of the pin boss and the longitudinal center line of said piston body, intersects the inner wall of the piston skirt and the second area includes at least a bottom portion of said pin boss portion;

wherein a second portion of the skirt defined between the first area and a bottom of the skirt has a rigidity lower than the rigidity of the first portion of the skirt.

2. A piston structure as set forth in claim 1, wherein said rib portion is curved along the inner wall of said skirt.

3. A piston structure as set forth in claim 1, wherein said skirt includes extending portions which diametrically oppose each other with respect to the longitudinal center line of said piston body and extend downwardly from portions below the first area.

4. A piston structure as set forth in claim 1, wherein said skirt has a flat bottom.

5. A piston structure as set forth in claim 1, wherein said rib portion includes two separate sections each of which has first, second, and third straight segments, said first segment extending along the inner wall of the skirt on a plane including the longitudinal axis of the pin boss, said second and third segments extending from ends of said first segment to said second area respectively.

6. A piston structure for an internal combustion engine comprising:

a piston body including a hollow skirt portion, said piston body having a longitudinal center line extending in a direction of reciprocating motion during combution;

pin boss portions provided in the skirt portion into which a piston pin is inserted for attaching said piston body to a connecting rod, said pin boss portions having a common longitudinal axis; and a rib portion projecting from an inner wall of said skirt portion to reinforce the rigidity of said skirt portion, said rib portion extending from a first area which includes at least the cross point where a line, perpendicularly passing the longitudinal axis of the pin boss and the longitudinal center line of said piston body, intersects the inner wall of the piston skirt to a second area which includes at least a bottom portion of said pin boss portion, wherein said rib portion includes four separate sections each extending from said first area to said second area.

7. A piston structure for an internal combustion engine comprising:

a piston body including a hollow skirt portion;

pin boss portions provided in the skirt portion into which a piston pin is inserted for attaching said piston body to a connecting rod, said pin boss portions diametrically opposed to each other;

a curved rib portion projecting from an inner wall of said skirt portion to provide reinforcement to the skirt portion, said curved rib portion extending along the inner wall of the skirt portion to form portions which provide rigidity to absorb side thrust acting on said piston body during combustion at both sides of said pin boss portion; and wherein said rib portion includes four separate sections each extending from said first area to said second area.

* * * * *